US007102276B2

(12) United States Patent
Lee et al.

(10) Patent No.: US 7,102,276 B2
(45) Date of Patent: Sep. 5, 2006

(54) RESONATOR OF ELECTRODELESS LIGHTING SYSTEM

(75) Inventors: Ji-Young Lee, Gyeonggi-Do (KR); Hyun-Jung Kim, Seoul (KR); Joon-Sik Choi, Seoul (KR); Yong-Seog Jeon, Gyeonggi-Do (KR); Yun-Chul Jung, Gyeonggi-Do (KR); Byeong-Ju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 246 days.

(21) Appl. No.: 10/756,359

(22) Filed: Jan. 14, 2004

(65) Prior Publication Data

US 2005/0052115 A1 Mar. 10, 2005

(30) Foreign Application Priority Data

Sep. 8, 2003 (KR) ..... 10-2003-0062738

(51) Int. Cl.
*H01J 65/04* (2006.01)

(52) U.S. Cl. ..... 313/161; 313/634

(58) Field of Classification Search ..... 313/493, 313/161, 634, 156, 160; 315/248, 344, 39
See application file for complete search history.

(56) References Cited

U.S. PATENT DOCUMENTS 4,743,315 A * 5/1988 Huang et al. ..... 148/429
4,821,006 A * 4/1989 Ishikawa et al. ..... 333/202
4,887,192 A * 12/1989 Simpson et al. ..... 362/265
4,933,602 A * 6/1990 Ono et al. ..... 315/39
5,397,555 A * 3/1995 Steinwandel et al. .... 423/215.5
5,714,919 A * 2/1998 Satoh et al. ..... 333/202
5,786,667 A * 7/1998 Simpson et al. ..... 315/39
5,905,342 A * 5/1999 Mimasu et al. ..... 315/39
2002/0135322 A1* 9/2002 Hochi et al. ..... 315/248
2003/0042857 A1* 3/2003 Suzuki et al. ..... 315/248

* cited by examiner

*Primary Examiner*—Ashok Patel
*Assistant Examiner*—Christopher M. Raabe
(74) *Attorney, Agent, or Firm*—Birch, Stewart, Kolasch & Birch, LLP

(57) ABSTRACT

A resonator of an electrodeless lighting system includes a body part formed in a prescribed shape; a transmission space part formed at one side of the body part and having an antenna of an microwave generator therein; a multi-step type resonating space part formed to be opened at one side, having a section gradually widening toward the opened side, receiving the microwave radiated from the antenna by means of an microwave feeder and resonating the microwave; and a stub formed at a certain height at an inner wall of the multi-step type resonating space part. Since the reflector for reflecting light has the enlarged size and is varied in its form to increase the amount of reflected parallel light, an illumination performance is enhanced. In addition, the impedance matching of the microwave exciting the gas filled in the electrodeless bulb and the resonance frequency are controllable.

24 Claims, 5 Drawing Sheets

RESONATOR OF ELECTRODELESS LIGHTING SYSTEM

This Nonprovisional application claims priority under 35 U.S.C. § 119(a) on patent application Ser. No(s). 10-2003-0062738 filed in KOREA on Sep. 8, 2003, the entire contents of which are hereby incorporated by reference.

BACKGROUND OF THE INVENTION

1. Field of the Invention

The present invention relates to an electrodeless lighting system and, more particularly, to a resonator of an electrodeless lighting system capable of increasing the size of a reflector reflecting light radiated from an electrodeless bulb, verifying forms of the reflector, and matching impedance of an electronic wave exciting gas-fill filled in the electrodeless bulb and controlling a resonance frequency.

2. Description of the Background Art

In general, in an electrodeless lighting system, gas-fill filled in an electrodeless bulb is excited to be converted into a plasma state, and a peripheral place is illuminated by light generated from plasma. The light generated by plasma is a natural light having an excellent illumination effect compared to the generally used incandescent electric lamp or a fluorescent lamp, and a life span of its bulb is longer.

FIG. 1 is a sectional view showing a general electrodeless lighting system, and FIG. 2 is a sectional view taken along line A-B of FIG. 1.

As shown in these drawings, the electrodeless lighting system includes: an microwave generator 10 for generating microwave energy; a resonator 20 having a resonating space 21 for resonating microwave generated from the electromagnetic generator 10; an microwave feeder 30 mounted in the resonating space 21 of the resonator and guiding microwave generated from the microwave generator 10 into the resonating space 21; an electrodeless lamp 40 positioned in the resonating space 21, connected to the microwave feeder 30, and generating plasma light by the resonated microwave energy; a reflector 50 for reflecting light generated from the electrodeless bulb 40 in a forward direction; and a transparent cover 60 mounted at a front side of the reflector 50 to prevent leakage of microwave and protect the electrodeless bulb 40.

The resonator 20 includes a main body 22 formed in a prescribed shape; the resonating space 21 formed in a cylindrical shape and having prescribed inner diameter and depth at one side of the main body 22; and a transmission space 23 formed communicating with the resonating space 21 in a vertical direction at one side of the main body 2, in which an antenna 11 of the microwave generator is positioned.

The resonating space 21 is opened at one side, and its inner diameter has a prescribed form. An inner circumferential surface of the resonating space 21 is coated with a dielectric material.

A coupling part 24 is formed at the opening side of the resonating space 21, to which the cover 60 is coupled. The coupling part 24 has prescribed depth and area, which are the same as the thickness and the area of the cover 60.

The microwave feeder 30 includes a first conductor bar 31 having a prescribed length, positioned in the transmission space 23 and connected to the antenna 11; and a second conductor bar 32 connected to the first conductor bar 31 and positioned at the center of the resonating space 21.

A conductor ring 70 for concentrate microwave is coupled at a boundary region between the resonating space 21 and the transmission space 23.

The electrodeless bulb 40 includes a bulb portion 41 filled with gas-fill and a stem portion 42 extended with a prescribed length from an outer circumferential surface of the bulb portion 41. The electrodeless bulb 40 is connected to the second conductor bar 32 in such a manner that the stem portion 42 is positioned to be level with the second conductor bar 32.

The reflector 50 includes a curved-surface portion 51 with a reflection surface at its inner side, a fixing portion 52 forming a circumference of the curved-surface portion 51 and coupled to the cover 60; and an insertion portion 53 formed at one side of the curved-surface portion 51, into which the stem portion 42 of the electrodeless bulb is inserted.

The reflector 50 is positioned at the open side of the resonating space 21 and encompasses the bulb portion 41 of the electrodeless bulb.

The cover 60 has prescribed thickness and area. When the cover 60 coupled to the reflector 50, it is coupled to the coupling part 24.

The electrodeless lighting system as described above is operated as follows.

First, when microwave is generated from the microwave generator 10 and oscillated through the antenna 11, the microwave is transferred into the resonating space 21 of the resonator through the microwave feeder 30. As the microwave is resonated in the resonating space 21, a strong electric field is formed at the electrodeless bulb 40 and the gas-fill filled in electrodeless bulb 40 is excited to generate plasma.

Light is emitted by plasma generated from the electrodeless bulb 40 and reflected by the reflector 50 to illuminate the front side.

In the electrodeless lighting system, the structure of the resonator 20 resonating microwave oscillated from the electromagnetic generator 10 is very critical to enhance a light efficiency by plasma. That is, the resonator should have a structure that a strong electric field resonated in the resonator 20 is formed at the side of the electrodeless bulb 40.

If the resonated strong electric field is not formed at the area where the electrodeless bulb 40 is positioned, longer time is taken to light and re-light the electrodeless bulb 40, and a light efficiency in generating light is degraded.

In addition, the electrodeless lighting system is expected to generate various outputs depending on a place where the electrodeless lighting system is installed and its purpose, and accordingly, the size or the shape of the reflector 50 reflecting light generated from the electrodeless bulb 40 needs to be varied in diverse forms.

However, the conventional electrodeless lighting system has the following problems.

That is, since the reflector 50 is positioned in the resonating space 21 of the resonator having a prescribed inner diameter, the size of the reflector 50 is limited and can be hardly changed to various forms. If the size of shape of the reflector 50 is changed, it is difficult to match impedance or control a resonance frequency by the resonating space 21.

In addition, since the reflector 50 is positioned in the cylindrical resonating space 21, the size of the reflector 50 is limited. Then, the amount of parallel light emitted from the electrodeless bulb 40 is reduced, making the illuminated region narrow, so the illumination efficiency deteriorates.

SUMMARY OF THE INVENTION

Therefore, one object of the present invention is to provide a resonator of an electrodeless lighting system capable of increasing the size of a reflector reflecting light emitted from an electrodeless bulb and varying the forms of the reflector.

Another object of the present invention is to provide a resonator of an electrodeless lighting system capable of mating an impedance of microwave exciting gas-fill filled in an electrodeless bulb and controlling a resonance frequency.

To achieve these and other advantages and in accordance with the purpose of the present invention, as embodied and broadly described herein, there is provided an electrodeless lighting system including an microwave generator, a resonator for resonating microwave generated from the microwave generator, an microwave feeder for guiding the microwave generated from the microwave generator into the resonator; an electrodeless bulb positioned inside the resonator and generating plasma light by the resonated microwave energy, and a reflector for reflecting light generated from the electrodeless bulb, wherein the resonator includes a body part formed in a prescribed shape; and a multi-step type resonating space part formed to be opened at one side and having a section gradually widening in its shape toward the opened side, at which the reflector is mounted.

To achieve the above objects, there is also provided a resonator of an electrodeless lighting system including: a body part formed in a prescribed shape; a transmission space part formed at one side of the body part and having an antenna of an microwave generator therein; a multi-step type resonating space part formed to be opened at one side, having a section gradually widening toward the opened side, receiving the microwave radiated from the antenna by means of an microwave feeder and resonating the microwave; and a stub formed at a certain height at an inner wall of the multi-step type resonating space part.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
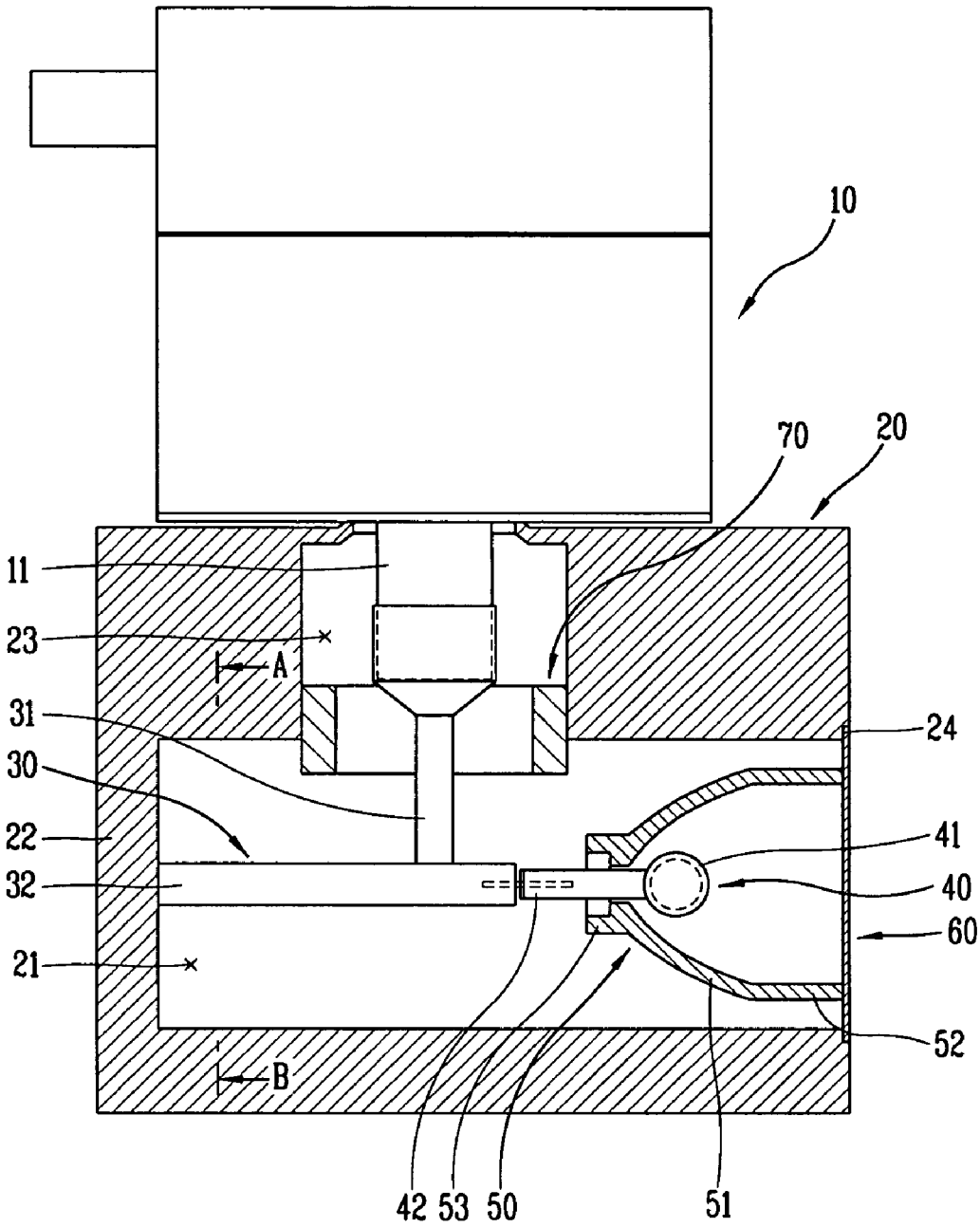
FIG. 1 BACKGROUND ART
FIG. 1 is a sectional view showing a general electrodeless lighting system.
Figure 2:
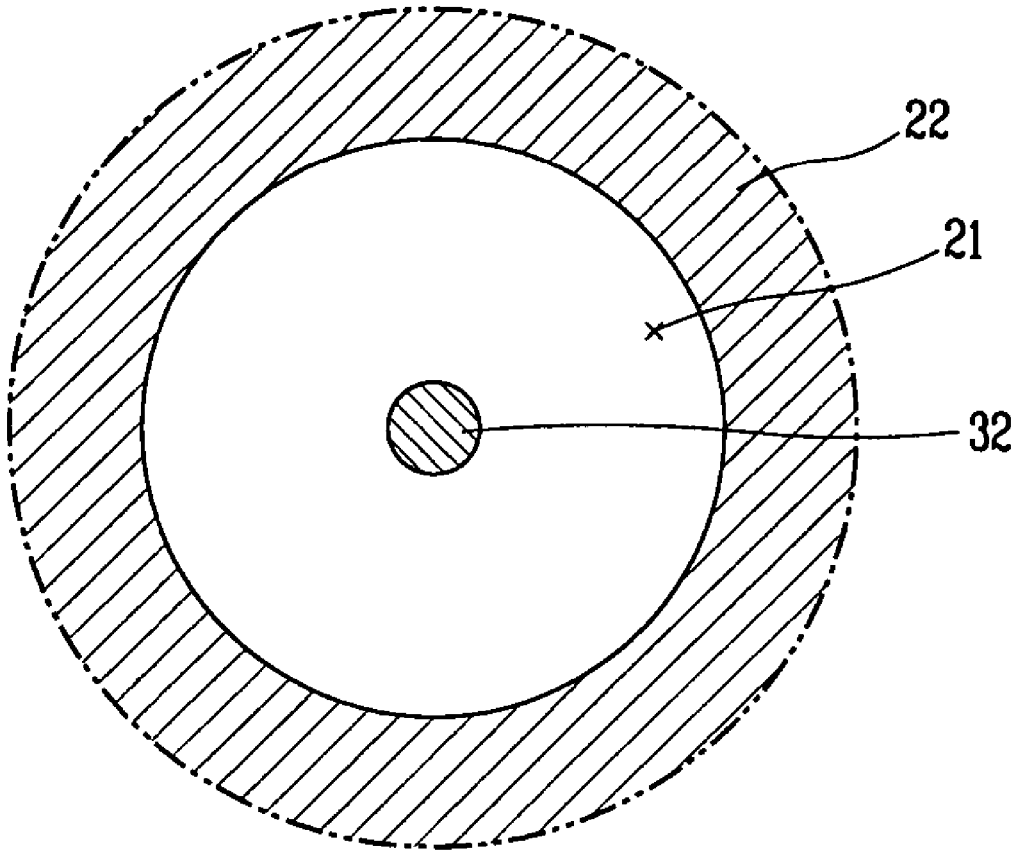
FIG. 2 BACKGROUND ART
FIG. 2 is a sectional view taken along line A-B of FIG. 1.
Figure 3:
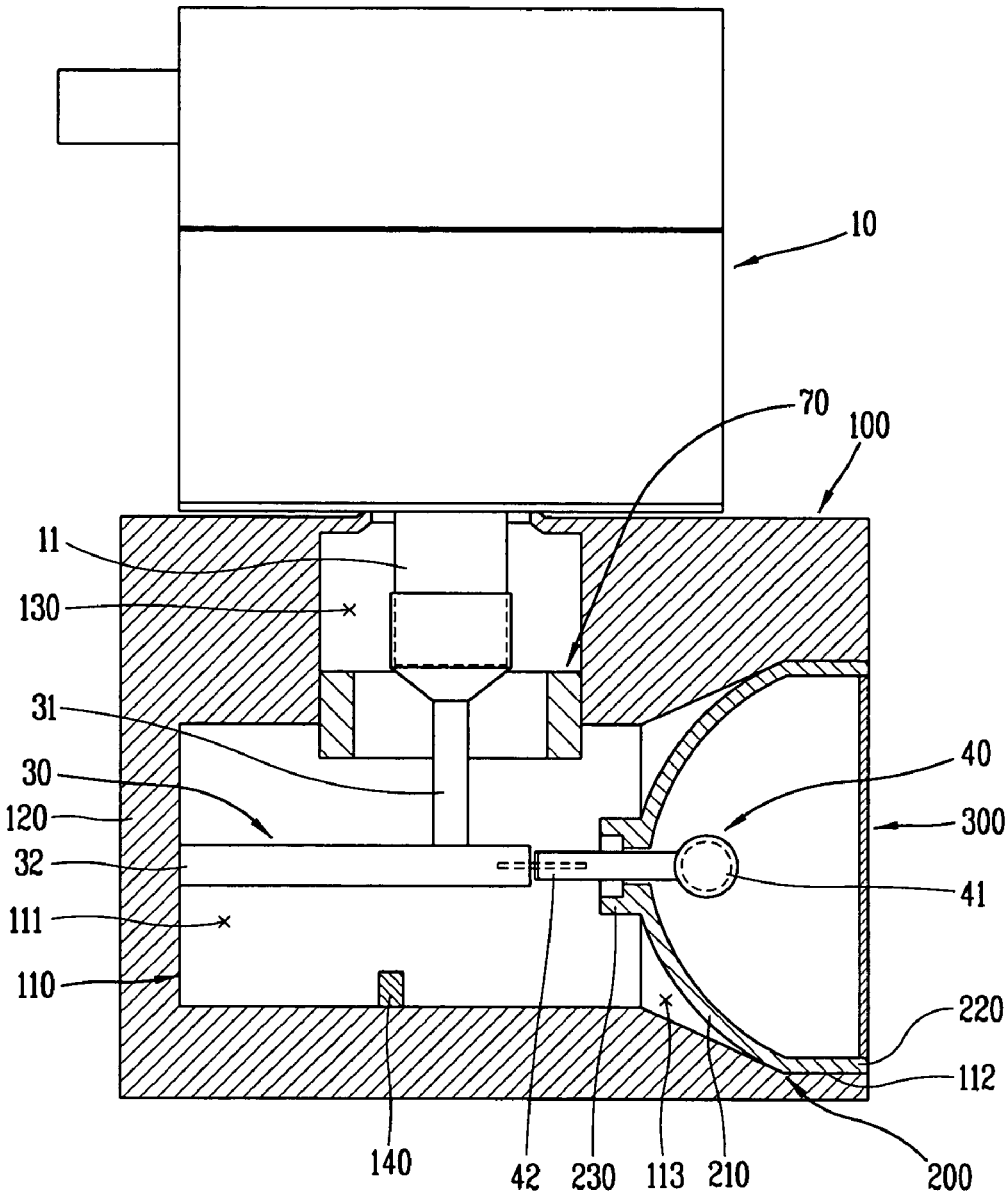
FIG. 3 is a sectional view showing an electrodeless lighting system including a resonator in accordance with the present invention.

FIG. 3 is a sectional view showing an electrodeless lighting system including a resonator in accordance with the present invention.

The same reference numerals as those in the conventional art are given to the same elements of the present invention.

As shown in FIG. 3, the electrodeless lighting system includes an microwave generator 10 for generating an microwave energy; a resonator 100 having a multi-step type resonating space part 110 for resonating the microwave generated from the microwave generator 10; an microwave feeder 30 mounted in the multi-step type resonating space part 110 of the resonator and guiding the microwave generated from the microwave generator 10 to the multi-step type resonating space part 110; an electrodeless bulb 40 positioned in the multi-step type resonating space part 110, connected to the microwave feeder 30 and generating plasma light by virtue of the resonated microwave energy; a reflector 200 for reflecting light generated from the electrodeless bulb 40 to the front side; and a transparent cover 300 mounted at a front side of the reflector 200, preventing leakage of microwave, and protecting the electrodeless bulb 40.

The resonator 100 includes a body part 120 having a prescribed shape; a multi-step type resonating space part 110 having one side opened at the body part 120 and a section gradually widening toward the opened side; a transmission space part 130 formed at one side of the body part 120 and communicating with the multi-step type resonating space part 110; and a stub 140 formed with a certain height at an inner wall of the multi-step type resonating space part 110.

The multi-step type resonating space part 110 includes a backward resonating space 111 having prescribed sectional shape and length; a forward resonating space 112 having certain sectional space and length greater than the size of the section shape of the backward resonating space 111; and a connection space 113 for connecting the backward resonating space 111 and the forward resonating space 112.

Figure 4:
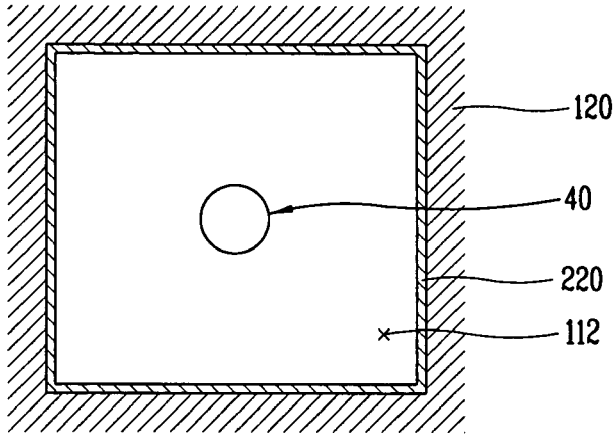
FIGS. 4 to 6 illustrate sections of a multi-step type resonating space part of the resonator of the electrodeless lighting system in accordance with the present invention.
Figure 5:
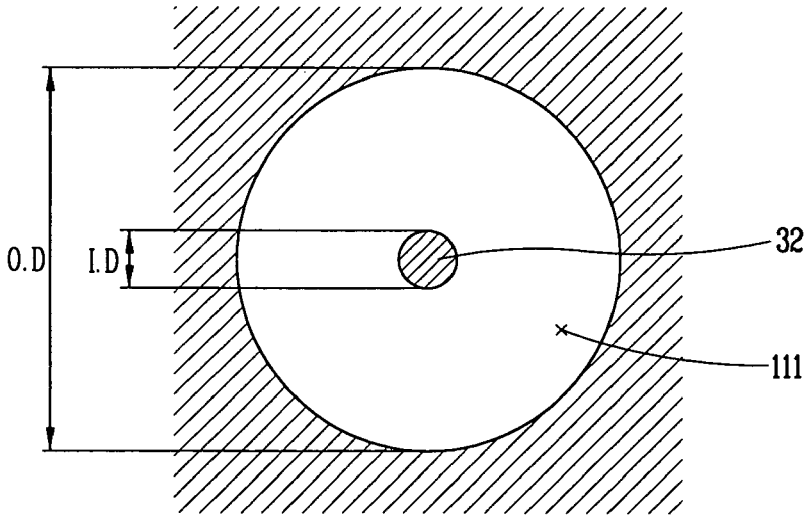

The section of the backward resonating space 111 has a circular shape and the section of the forward resonating space 112 has a square shape as shown in FIG. 4.

The size of the section of the backward resonating space 111, that is, an inner diameter (O.D) of the backward resonating space 111, and the size (I.D) of the section of the microwave feeder 30 positioned in the multi-step type resonating space 110 are in the ratio of 10:1. Namely, if the inner diameter (O.D) of the backward resonating space 111 is 100 mm, the size of the section of the microwave feeder 30 is equal to or smaller than 10 mm.

The backward resonating space 111 is longer than the connection space 113, and the connection space 113 is longer than the forward resonating space 112. The length of the connection space 113 is greater than ¼ of a wavelength of a resonance frequency.

A dielectric layer is coated on the inner circumferential surface of the multi-step type resonating space part 110.

The transmission space part 130 is formed at the side where the size of the section of the multi-step type resonating space part 110 is the smallest, and communicates with the multi-step type resonating space part 110. That is, the transmission space part 130 communicates with the backward resonating space 111. The transmission space part 130 has a certain diameter except for an entrance side.

The antenna 11 of the microwave generator 10 is positioned in the transmission space part 130 of the resonator and coupled with the resonator 100 therein.

Figure 6:
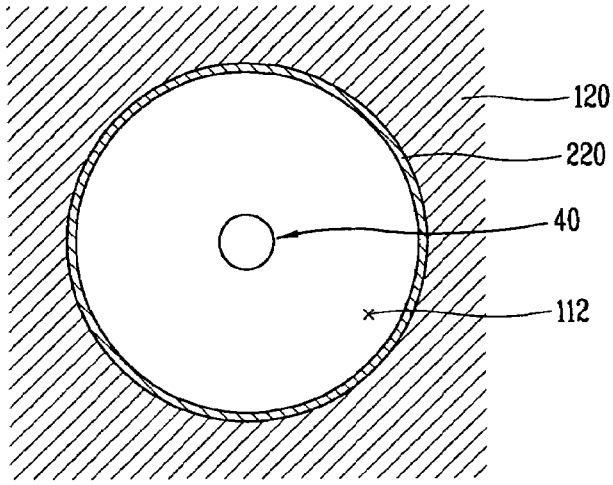

FIG. 6 shows a modification of the multi-step type resonating space part 110. As shown in FIG. 6, the backward resonating space 111 has a circular section and the forward resonating space 112 also has a circular section.

The multi-step type resonating space 110 can have various shapes.

The stub 140 is formed at the inner wall of the multi-step type resonating space 110. That is, the stub 140 is formed at an inner circumferential wall of the backward resonating space 111. The stub 140 can be positioned anywhere on the inner circumferential wall of the backward resonating space 111, and preferably, it is positioned at the opposite side of the transmission space part 130.

Figure 7:
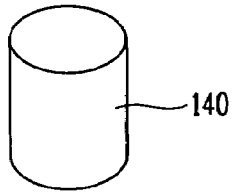
FIG. 7 is a perspective view showing a stub constituting the resonator of the electrodeless lighting system in accordance with the present invention.

As shown in FIG. 7, the stub 140 has a cylindrical form in its section, and preferably, the stub 140 has a diameter equal to or smaller than 20 mm and a height equal to or smaller than 15 mm.

Figure 8:
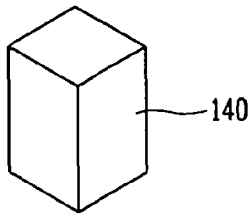
FIG. 8 is a perspective view showing a different stub constituting the resonator of the electrodeless lighting system in accordance with the present invention.

In addition, as shown in FIG. 8, the stub 140 can be modified to a hexahedral form with a square-shaped section. Preferably, the stub 140 has width and length equal to or smaller than 20 mm, and height equal to or smaller than 15 mm.

The stub 140 can be implemented in various forms.

The microwave 30 includes a first conductor bar 31 having a certain length, positioned in the transmission space part 130 and connected to the antenna 11; and a second conductor bar 32 having a certain length, positioned at the center of the multi-step type resonating space part 110, and connected to the first conductor bar 31. That is, the second conductor bar 32 is positioned on the central line of the multi-step type resonating space part 110. And as mentioned above, an outer diameter of the second conductor bar 32 is smaller than 1/10 of the inner diameter of the backward resonating space 111.

A conductor ring 70 for concentrating microwave is coupled to the transmission space unit 130, and the conductor ring 70 is positioned in the boundary region between the multi-step type resonating space part 110 and the transmission space part 130. The conductor ring 70 has prescribed thickness and length, and its outer diameter corresponds to the inner diameter of the transmission space part 130.

The electrodeless bulb 40 includes a bulb portion 41 filled with gas-fill therein and a stem portion 42 extended with prescribed length and outer diameter from an outer circumferential surface of the bulb portion 41. The electrodeless bulb 40 is connected to the second conductor bar 32 and positioned at the same level with the second conductor bar 32.

The reflector 200 includes a curved-surface portion 210 formed to be concave spherical surface; a fixing portion 220 formed extended with a prescribed length at an edge of the curved-surface portion 210; and an insertion portion 230 formed at the other side of the curved-surface portion 210, into which the stem portion 42 of the electrodeless bulb is inserted.

The length of the curved-surface portion 210 corresponds to the length of the connection space of the multi-step type resonating space part 110. The shape of the front side of the fixing portion 220 corresponds to the shape of the forward resonating space 112 of the multi-step type resonating space part 110.

That is, if the forward resonating space 112 has a circular shape, the front side of the fixing portion 220 is formed in a circular shape, and if the forward resonating space 112 has a rectangular shape, the front side of the fixing portion 220 is formed in a rectangular shape.

The reflector 200 is inserted into the opening side of the multi-step type resonating space part 110. At this time, the curved-surface portion 210 is positioned in the connection space 113 and the fixing portion 220 is positioned in the forward resonating space 112. The stem portion 42 of the electrodeless bulb 40 is inserted into the insertion portion 230 and the bulb portion 41 is positioned at the inner side of the curved-surface portion 210.

The cover 300 is fixedly coupled at an entrance of the fixing portion 220 of the reflector.

The electrodeless lighting system having the resonator is operated as follows.

First, when microwave is generated from the microwave generator 10 and oscillated through the antenna 11, the microwave is transferred to the multi-step type resonating space part 110 of the resonator through the microwave feeder 30. As the microwave is resonated in the multi-step type resonating space part 110, a strong electric field is formed around the electrodeless bulb 40, making gas-fill filled in the electrodeless bulb 40 excited to generate plasma. At this time, the stub 140 positioned in the multi-step type resonating space part 110 of the resonator controls the electromagnetic field formed in the multi-step type resonating space part 110.

Plasma generated from the electrodeless bulb 40 emits light, and the light is reflected by the reflection surface of the curved-surface portion 210 of the reflector, illuminating the front side.

In the present invention, the resonating space for resonating microwave, that is, the multi-step type resonating space part 110 has an enlarged opening side, so the size of the reflector 200 positioned at the opening side of the multi-step type resonating space part 110 is big and various in forms, increasing the amount of parallel light reflected by the reflector 200.

In addition, in the case that the forward resonating space 112 of the multi-step resonating space part 110 has a rectangular shape, not only light emitted from the electrodeless bulb 40 can be effectively reflected forward together with the cover 300 but also a microwave shielding performance can be improved.

The impedance matching and the resonance frequency are controlled by adjusting the section size, that is, the inner diameter, of the multi-step type resonating space part 110 and the outer diameter of the microwave feeder 300 positioned in the multi-step type resonating space part 110 and also adjusting the shape or position of the stub 140 formed in the multi-step type resonating space part 110.

Difficulties in resonance designing that may be considered for the multi-step type resonating space part 110, that is, in such a structure that the size of the section form increases as it goes to the opening side, can be easily solved by the shape or installation position of the stub 140 and the microwave feeder 30.

As so far described, the electrodeless lighting system of the present invention has the following advantages.

That is, for example, since the reflector 200 for reflecting light has the enlarged size and is varied in its form to increase the amount of reflected parallel light, an illumination performance is enhanced and a utilization range of a product is extended.

In addition, since the impedance matching of the microwave exciting the gas filled in the electrodeless bulb 40 and the resonance frequency are controllable, a stronger magnetic field is formed around the electrodeless bulb 40 and a light efficiency is heightened.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A resonator for an electrodeless lighting system, the electrodeless lighting system including an microwave generator for generating a microwave, a resonator for resonating the microwave, a microwave feeder for guiding the microwave from the microwave generator into the resonator, an electrodeless bulb positioned inside the resonator and generating plasma light by a resonated microwave energy, and a reflector for reflecting the light generated from the electrodeless bulb;

the resonator comprising:

a multi-step resonating body, the multi-step resonating body having an opened side, a connection space with a gradually widened cross-section toward the opened side, and a backward resonating space, the reflector being mountable at the opened side such that the backward resonating space is located behind the reflector.

2. The resonator of claim 1, wherein the backward resonating space has a substantially uniform cross-section facing the opened side.

3. The resonator of claim 2, wherein the multi-step resonating body further comprises:

a forward resonating space extending from the opened side, the forward resonating space having a substantially uniform cross-section facing the opened side wider than the cross-section of the backward resonating space, the connection space connecting the backward resonating space and the forward resonating space.

4. The resonator of claim 3, wherein the cross-section of the backward resonating space has a circular shape and the cross-section of the forward resonating space also has a circular shape.

5. The resonator of claim 3, wherein the cross-section of the backward resonating space has a circular shape and the cross-section of the forward resonating space has a square shape.

6. The resonator of claim 3, wherein a size (O.D) of the cross-section of the backward resonating space and a size (I.D) of the cross-section of the microwave feeder positioned in the multi-step resonating body are in the ratio of 10:1.

7. The resonator of claim 3, wherein a length of the connection space is greater than ¼ of a wavelength of a resonance frequency.

8. The resonator of claim 3, wherein the backward resonating space is longer than the connection space, and the connection space is longer than the forward resonating space.

9. The resonator of claim 3, wherein a stub is located at an inner wall of the multi-step resonating body.

10. The resonator of claim 9, wherein the stub is located at an inner circumferential wall of the backward resonating space.

11. The resonator of claim 9, wherein a cross-section of the stub has a circular shape.

12. The resonator of claim 11, wherein the stub has a diameter equal to or smaller than 20 mm and a height equal to or smaller than 15 mm.

13. The resonator of claim 9, wherein a cross-section of the stub has a square shape.

14. The resonator of claim 13, wherein the stub has a width and a length respectively equal to or smaller than 20 mm and a height equal to or smaller than 15 mm.

15. The resonator of claim 3, wherein a length of the connection space is equivalent to a length of a curved-surface portion of the reflector.

16. The resonator of claim 3, wherein a shape of an edge portion of the reflector corresponds to a shape of the forward resonating space.

17. The resonator of claim 1, wherein the multi-step resonating body has a closed side opposite to the opened side.

18. The resonator of claim 1, wherein the connection space has a linearly widened cross-section toward the opened side.

19. A resonator of an electrodeless lighting system comprising:

a transmission space part having an antenna of a microwave generator therein;

a multi-step resonating body, the multi-step resonating body having an opened side, a connection space with a gradually widened cross-section toward the opened side, and a backward resonating space, the multi-step resonating body receiving the microwave radiated from the antenna via a microwave feeder and resonating the microwave, a reflector of the electrodeless lighting system being mountable at the opened side such that the backward resonating space is located behind the reflector; and a stub located at an inner wall of the multi-step resonating body.

20. The resonator of claim 19, wherein the backward resonating space has a substantially uniform cross-section facing the opened side.

21. The resonator of claim 20, wherein the multi-step resonating body comprises:

a forward resonating space extending from the opened side, the forward resonating space having a substantially uniform cross-section facing the opened side wider than the cross-section of the backward resonating space, the connection space connecting the backward resonating space and the forward resonating space.

22. The resonator of claim 19, wherein the stub is located at the backward resonating space.

23. The resonator of claim 19, wherein the multi-step resonating body has a closed side opposite to the opened side.

24. The resonator of claim 19, wherein the connection space has a linearly widened cross-section toward the opened side.

* * * * *